US007552809B2

(12) United States Patent
Lu

(10) Patent No.: US 7,552,809 B2
(45) Date of Patent: Jun. 30, 2009

(54) COIN OPERATED DEVICE

(75) Inventor: Chien-Chih Lu, Kaohsiung County (TW)

(73) Assignee: MIZ Engineering Ltd., Kaohsiung County (TW)

( * ) Notice: Subject to any disclaimer, the term of this patent is extended or adjusted under 35 U.S.C. 154(b) by 87 days.

(21) Appl. No.: 11/898,737

(22) Filed: Sep. 14, 2007

(65) Prior Publication Data

US 2009/0071794 A1 Mar. 19, 2009

(51) Int. Cl.

| | |
|---|---|
| ***G07F 5/00*** | (2006.01) |
| ***G07F 11/00*** | (2006.01) |
| ***G07F 13/00*** | (2006.01) |
| ***G07F 15/00*** | (2006.01) |
| ***G07F 17/00*** | (2006.01) |

(52) U.S. Cl. ..... 194/247; 194/334

(58) Field of Classification Search ..... 194/247, 194/253, 259, 282, 283, 288, 289, 284, 334, 194/338; 70/DIG. 41

See application file for complete search history.

(56) References Cited

U.S. PATENT DOCUMENTS 5,573,098 A * 11/1996 Widmer ..... 194/212

* cited by examiner

*Primary Examiner*—Jeffrey A Shapiro
(74) *Attorney, Agent, or Firm*—Muncy, Geissler, Olds & Lowe, PLLC

(57) ABSTRACT

The present invention discloses a coin operated device, whereby the articles inside the locker can still be taken out with the spare key of the locker provider without damaging the coin operated device when the key is lost. The coin operated device is installed in the door frame of a locker and comprises first and second lock cylinders respectively for the insertion of the spare key and the key. The second lock cylinder is used to lock or unlock the locker, wherein a coin is inserted into the coin operated device, and a coin triggered module lets the coin fall into a coin accommodation module; then, the key is turned to latch the lock tongue and lock the locker, and the coin accommodation module is simultaneously driven to let the coin stay in behind the coin return.

20 Claims, 17 Drawing Sheets

COIN OPERATED DEVICE

FIELD OF THE INVENTION

The present invention relates to a coin operated device, particularly to a coin operated device, which is installed in the door frame of a locker, whereby the articles inside the locker can still be taken out with the spare key of the locker provider without damaging the coin operated device when the key is lost.

BACKGROUND OF THE INVENTION

In the conventional coin operated lockers, the coin slot and lock cylinder of a coin operated lock are respectively arranged in the upper side and lower side of a locker. After a coin is deposited, the key is withdrawn from the lock cylinder and kept by the user. Once the key is lost, the coin operated lock cannot be unlocked. The conventional coin operated lock has the following disadvantages:

1. The lock cylinder is arranged only in the lower side of a conventional coin operated locker. If the locker has been locked and the key should be lost, the latched lock tongue is hard to be unlocked with a tool in a short period of time. Thus, a locksmith is needed to break the lock, and an expense is also needed to repair or replace the lock.
2. Once the lock cylinder or lock tongue of a conventional coin operated lock is broken, the coin operated lock cannot work any more.

SUMMARY OF THE INVENTION

The present invention provides a coin operated device, which is installed in the door frame of a locker. When the key of the locker is lost, a spare key is inserted into a first lock cylinder and turned to drive a second lock cylinder to unlatch the lock tongue and detach the coin operated device from the door frame of the locker. Thus, the articles inside the locker can be taken out.

The coin operated device of the present invention functions as follows. A second lock cylinder is used to lock or unlock a locker, wherein a coin is inserted into the coin operated device and enters a coin triggered module and then reaches a coin accommodation module; thus, the key is turned to latch the lock tongue and lock the locker, and the coin accommodation module is simultaneously driven to let the coin stay in behind the coin return. When the key is lost, a spare key is used to drive the second lock cylinder to unlatch the lock tongue and detach the coin operated device from the door frame of the locker. Thus, the articles inside the locker can be taken out. Therefore, via the present invention, the articles inside the locker can still be taken out without damaging the coin operated device when the key is lost.

DETAILED DESCRIPTION OF THE PREFERRED EMBODIMENTS

Figure 1:
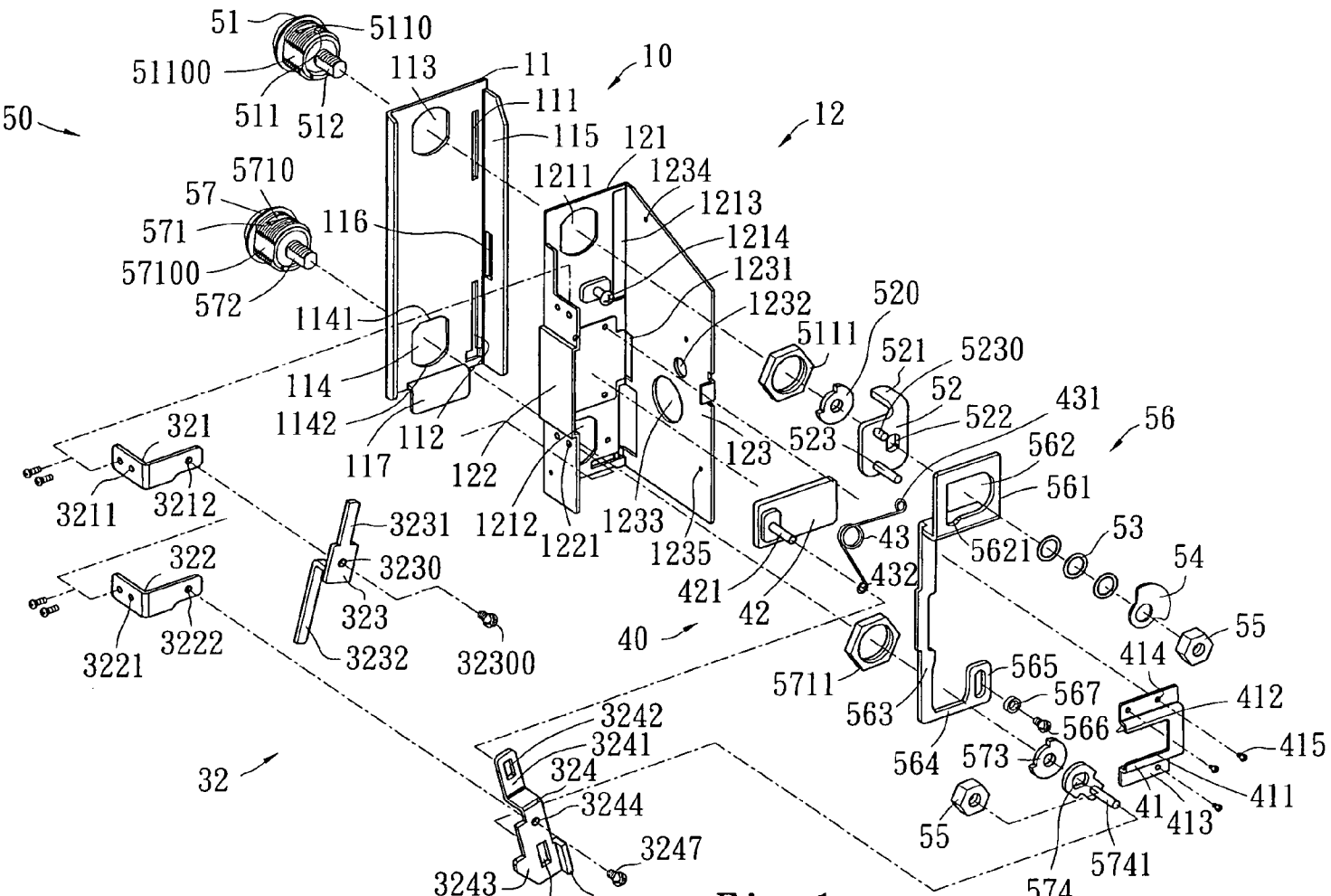
FIG. 1 is an exploded view schematically showing the casing module, lock tongue module lock and cylinder module according to the present invention.
Figure 3:
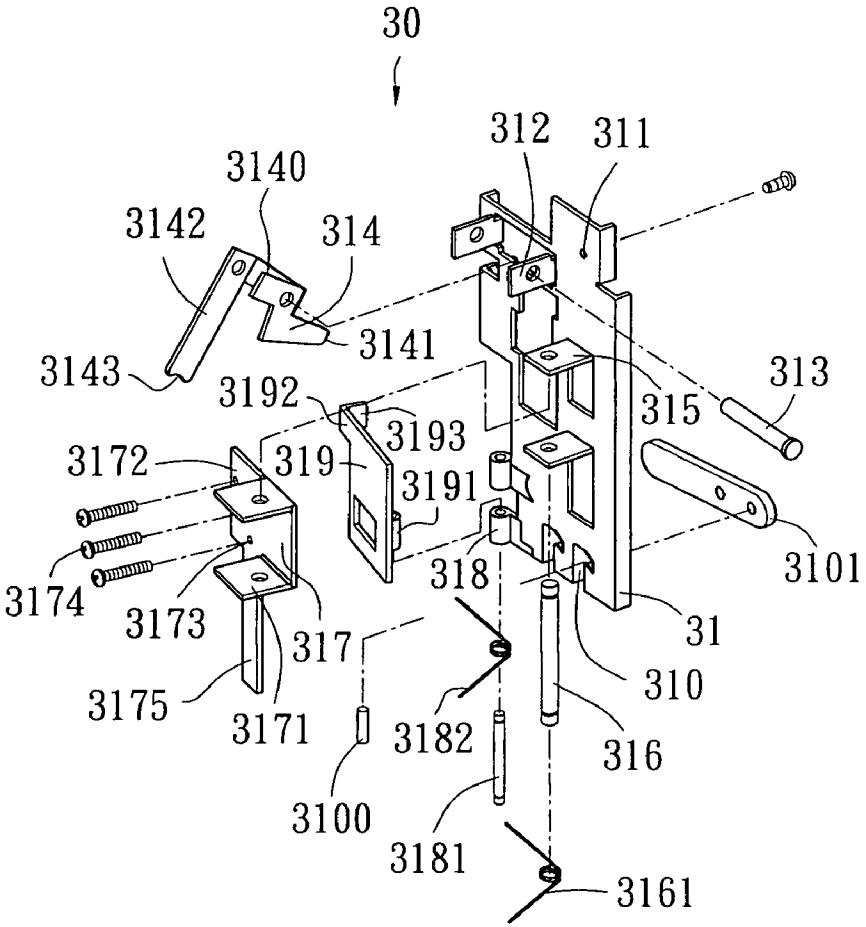
FIG. 3 is an exploded view schematically showing the coin accommodation module according to the present invention.
Figure 2:
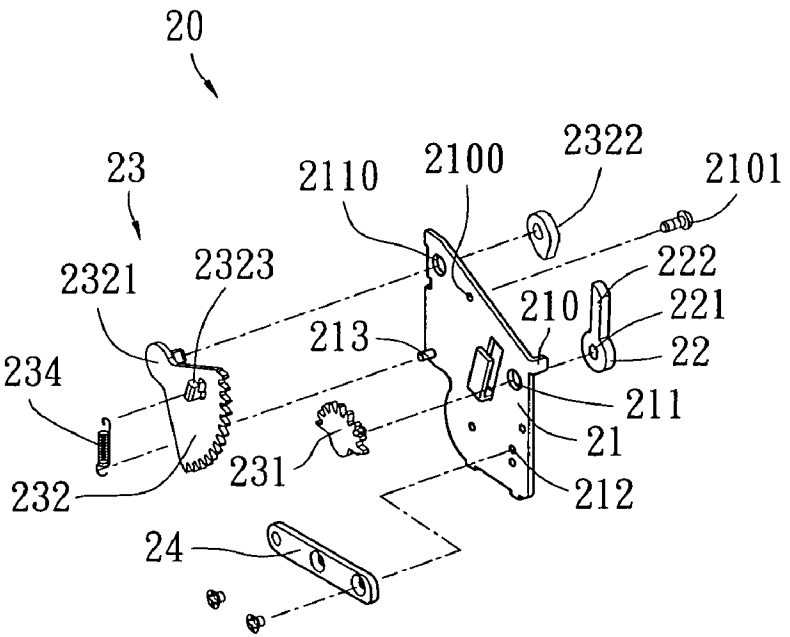
FIG. 2 is an exploded view schematically showing the coin triggered module according to the present invention.

Refer to from FIG. 1 to FIG. 5. The present invention proposes a coin operated device, which is installed at the door frame of a locker 80 and comprises: a casing module 10, a coin triggered module 20, a coin accommodation module 30, a lock tongue module 40 and a lock cylinder module 50.

The casing module 10 has a housing 11 and a mounting frame 12, which can be fixed to each other. The housing 11 has a reversed U-shape structure. The housing 11 has a coin slot 111 and a coin return 112 respectively at the upper portion and lower portion of one side thereof. The central portion of the housing 11 has a first through-hole 113 and a second through-hole 114. The first through-hole 113 is an elongated hole. The second through-hole 114 has a trapezoid shape 1141 at the upper side thereof and an arc shape 1142 at the lower side thereof. One side of the housing is bent to form a bent plate 115. The bent plate 115 has a through-hole 116 near the center thereof and has a press-fit plate 117 at the lower end thereof. The press-fit plate 117 is to be press-fitted to the door frame of the locker 80. One plate 121 of the mounting frame 12 has a first through-hole 1211 and a second trough-hole 1212 respectively corresponding to the first through-hole 113 and second through-hole 114 of the housing 11. One side of the mounting frame 12 has a through-hole 1213 corresponding to the coin slot 111. A threaded pole 1214 is arranged beside the through-hole 1213. A fixing plate 122 and a positioning plate 123 respectively extend from two sides of the plate 121 and are vertical to the plate 121. Fixing holes 1221 are respectively arranged at the upper and lower sides of the fixing plate 122. The inner side of the positioning plate 123 has a through-hole 1231 corresponding to the through-hole 116 of the housing 11. The positioning plate 123 also has a hole 1232 and a through-hole 1233 and further has fixing holes 1234 and 1235 diagonally arranged in the upper and lower sides thereof.

The coin triggered module 20 is installed at the upper side of the positioning plate 123 of the mounting frame 12 and comprises: a positioning block 21, a movable rod 22 pivotally installed on one side of the positioning block 21, a transmission gear module 23 pivotally installed on the other side of the positioning block 21 and corresponding the movable rod 22, and a fixing block 24 fixed to the lower side of the positioning block 21. The positioning block 21 has a protrusion 210 at one corner thereof. The upper side of the positioning block 21 has a through-hole 2100, which will coincide with the fixing hole 1234 of the positioning plate 123 and then be fixed together for positioning. A slideway 25 for a coin 60 is formed between the positioning block 21 and the positioning plate 123. The positioning block 21 has two pivotal holes 211 and 2110 respectively at two ends of the upper side thereof and has a plurality of holes 212 at the lower side thereof. One end of the movable rod 22 is a pivotal end 221, which is pivotally coupled to the inner side of the pivotal hole 211 of the positioning block 21. The other end of the movable rod 22 is a swing rod 222. The transmission gear module 23 has a passive gear 231 and an active gear 232, which are engaged to each other. The passive gear 231 is pivotally coupled to the outer side of the pivotal hole 211 of the positioning block 21 and corresponding to the pivotal end 221 of the movable rod 22. The pivotal end 2321 of the active gear 232 is pivotally coupled to another pivotal hole 2110 and a triggering member 2322. The active gear 232 also has a hook 2323. The hook 2323 is used to hook an elastic element 234, which is fixed to a rod 213 arranged below the pivotal hole 2110 of the positioning block 21. The fixing block 24 is fixed to the holes 212 at the lower side of the positioning block 21.

The coin accommodation module 30 is installed in the lower end of the inner side of the positioning plate 123 of the mounting frame 12 and comprises: a separating board 31 and a driving module 32. The separating board 31 has a fixing hole 311 at the upper side thereof and two protrusion plates 312 formed at one side thereof via a stamping method. A protrusion board 314 is pivotally coupled to the protrusion plates 312 with a shaft 313. Two protrusion plates 315 are formed at the other side of the separating board 31 via a stamping method. A blocking member 317 is pivotally coupled to the protrusion plates 315 via a shaft 316, and a spring 3161 sleeves one end of the shaft 316. The blocking member 317 has two protrusion plates 3171 corresponding to and pivotally coupled to two protrusion plates 315. The protrusion plate 3172 below the protrusion plates 3171 has several threaded holes 3173, and several screw elements 3174 will be screwed into the threaded holes 3173. One protrusion plate 3171 extends a long plate 3175, which corresponds to the end of the shaft 316 and is penetrated by the spring 3161. Two protrusion blocks 318 are formed at the lower end of one side of the separating board 31 via a stamping method. A movable plate 319 together with a spring 3182 is pivotally coupled to the protrusion blocks 318 via a shaft 3181. The movable plate 319 can thus elastically rotate around the shaft 3181 with the aid of the spring 3182. The lower end of the separating board 31 has two notches 310. A stop block 3101 can be fixed to the notches 310 via bolts 3100. The stop block 3101 is used to block the end of a slideway 33. When the stop block 3101 is not fixed to the notches 310, a coin 60 may run along the slideways 25 and 33 to a coin collecting hole (not shown in the drawings).

The driving module 32 comprises: positioning members 321 and 322, a first movable member 323, and a second movable member 324. The positioning members 321 and 322 are similar to a segment of angle steel and respectively fixed to the fixing holes 1221 of the fixing plate 122 of the mounting frame 12. One face of the positioning member 321/322 has a threaded hole 3211/3221 corresponding to the fixing hole 1221. The other face of the positioning member 321/322 has a threaded hole 3212/3222. The first movable member 323 has a hole 3230. A screw 32300 passes through the hole 3230 and fixes the first movable member 323 to the threaded hole 3212 of the positioning member 321. One end of the first movable member 323 has an extension member 3231, and the other end is crooked into a swing plate 3232. The swing plate 3232 is arranged above an elastic element 43 of the lock tongue module 40. The second movable member 324 has an inserted plate 3241. The inserted plate 3241 has an elongated hole 3242, which a rod 421 of a lock tongue 42 will be inserted into. The second movable member 324 also has an inserted plate 3243. The inserted plate 3243 has a hole 3244, an elongated hole 3245, and a press plate 3246, which is formed via bending the lateral side of the inserted plate 3243. A screw 4247 passes through the hole 324 and fixes the second movable member 324 to the threaded hole 3222 of the positioning member 322.

The protrusion board 314 has a shape similar to "7". The terminal protrusion 3141 of the protrusion board 314 penetrates the hole 1232 of the positioning plate 123. A connecting plate 3140 connects the top of the protrusion board 314 with a press block 3142. The end of the press block 3142 has a notch 3143 contacting the rod 421 of the lock tongue 42. The protrusion board 314 and the press block 3142 are pivotally coupled to the protrusion plates 312 with the shaft 313.

The movable plate 319 is a crooked plate, and one side thereof has a protrusion 3191, which is to be pivotally coupled to the protrusion blocks 318. One corner of the movable plate 319 has an oblique arm 3192, and the oblique arm 3192 has a blocking plate 3193. The oblique arm 3192 is obliquely arranged in a lateral side of the separating board 31, and the blocking plate 3193 is arranged above the coin return 112 to prevent a coin 60 from directly falling to the coin return 112.

The lock tongue module 40 is arranged near the center of the inner side of the housing 11 and comprises: a positioning block 41, a lock tongue 42 and an elastic element 43. The positioning block 41 has notches 411, slideways 412 in the lateral sides of the notches 411, and fixing edges 413 in the lateral sides of the positioning block 41. The fixing edge 413 has fixing holes 414, which fixing screws 415 are to be inserted into. The lock tongue 42 has a rod 421 and is arranged and slides in the slideways 412 of the positioning block 41. When in a locking state, the lock tongue 42 penetrates the through-hole 1231 of the positioning plate 123 and the through-hole 116 of the bent plate 115. One end 431 of the elastic element 43 hooks the threaded pole 1214 of the plate 121, and the other end 432 of the elastic element 43 hooks the rod 421 of the lock tongue 42.

The lock cylinder module 50 comprises: a first lock cylinder 51 and a second cylinder 57. The first lock cylinder 51 is inserted into the first through-hole 113 of the housing 11 and the first through-hole 1211 of the plate 121. The second lock cylinder 57 is inserted into the second through-hole 114 of the housing 11 and the second through-hole 1212 of the plate 121. The first lock cylinder 51 has an external threaded portion 511 and a threaded pole 512. The external threaded portion 511 has a slot 5110 and two flattened faces 51100 arranged oppositely. The external threaded portion 511 is screwed into a nut 5111. The threaded pole 512 passes through a tenon block 52 having a blocking plate 520, a plurality of washers 53 and a positioning plate 54, and then they are locked by a locking element 55, such as a nut. The upper corner of the tenon block 52 is bent to form a blocking plate 521. The tenon block 52 has a through-hole 522, which the threaded pole 512 passes through. Two rods 523 and 5230 are formed on one side of the tenon block 52. Please also refer to FIG. 6. The rods 523 and 5230 pass through a fixing plate 56. The upper portion of the fixing plate 56 is bent to form a positioning plate 561, and the positioning plate 561 has an opening 562, which the threaded pole 512 of the first lock cylinder 51 and the rods 523 and 5230 of the tenon block 52 pass through. Then, the positioning plate 54 is arranged above the opening 562. Thus, the first lock cylinder 51 can be rotated to perform a positioning function. The lower portion of the fixing plate 56 is bent to form a vertical plate 563 and a horizontal plate 564, and a fixing plate 565 extends from the terminal of the horizontal plate 564. A screw 566 passes through a washer 567 and the fixing plate 565 to fix the fixing plate 56 to the inner side of the casing module 10.

The second lock cylinder 57 has an external threaded portion 571 and a threaded pole 572. The external threaded portion 571 has a slot 5710 and two flattened faces 57100 arranged oppositely. The external threaded portion 571 is screwed into a nut 5711. The threaded pole 572 passes through a stop plate 573 and a block 574, which has a rod 5741 penetrating the elongated hole 3245 of the second movable member 324, and then they are locked by a locking element 55, such as a nut.

Figure 4:
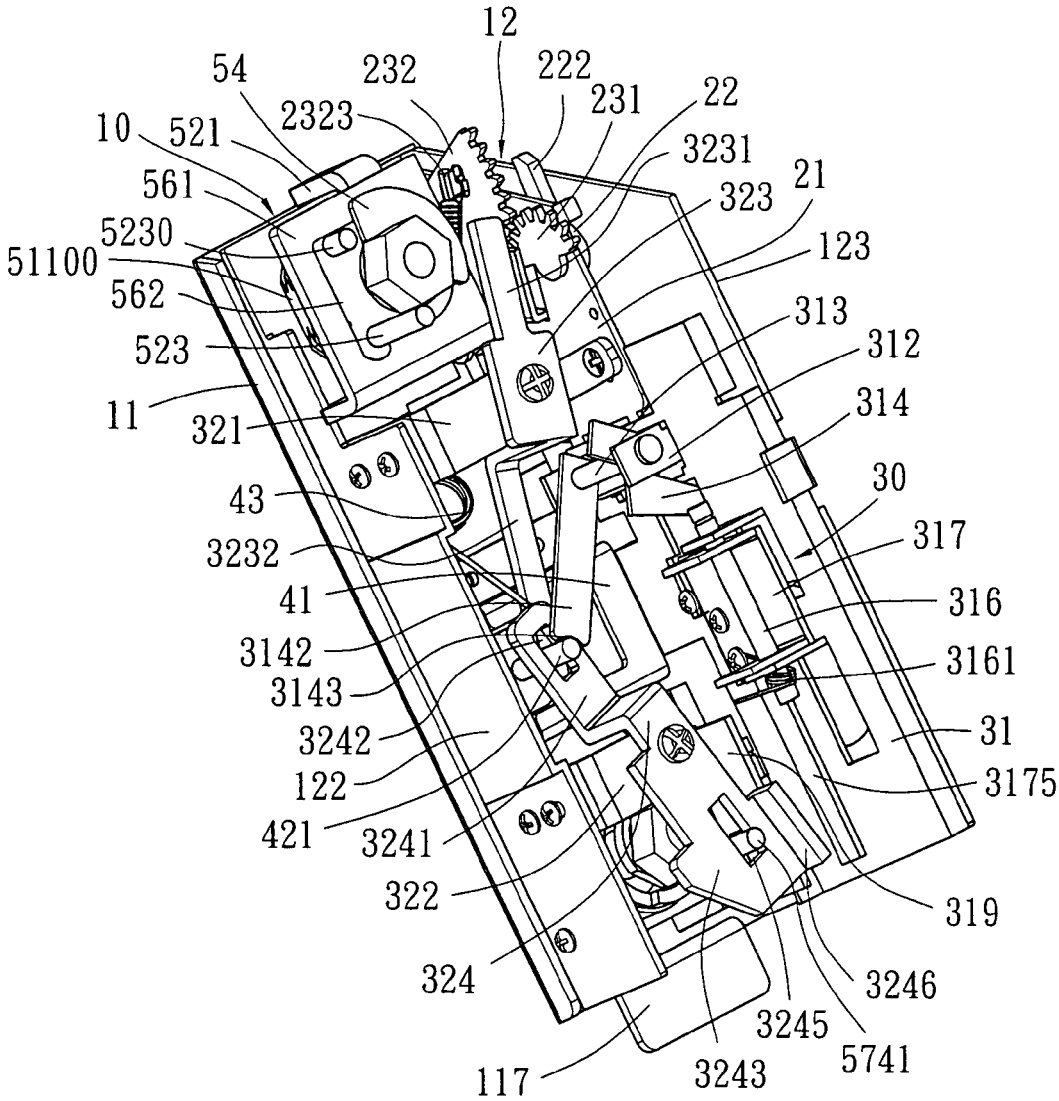
FIG. 4 is a perspective view schematically showing the appearance of the present invention.
Figure 6:
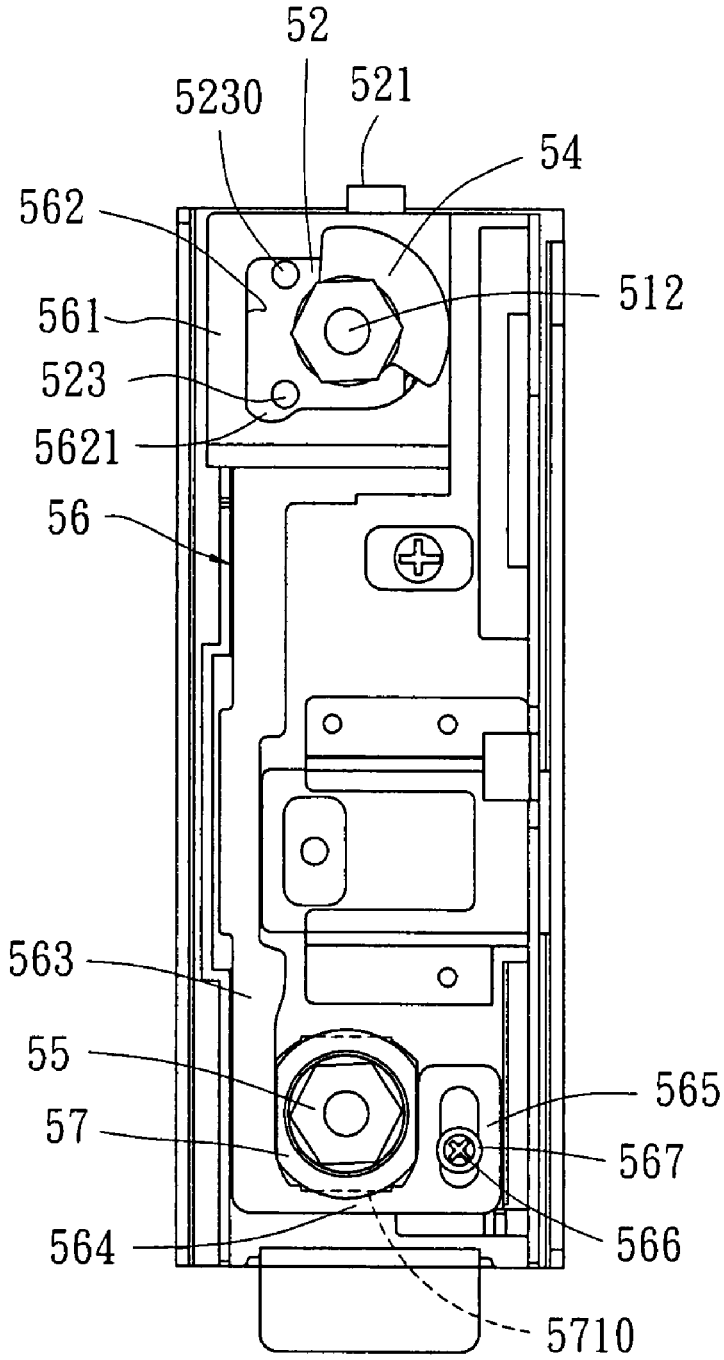
FIG. 6 is a diagram schematically showing that the second lock cylinder is wedged in the casing module according to the present invention.

Refer to the abovementioned drawings, FIG. 4 and FIG. 6. After the housing 11 and mounting frame 12 of the casing module 10 is assembled, the coin triggered module 20 and coin accommodation module 30 are respectively fixed to the upper and lower parts of the inner side of the positioning plate 123 of the mounting frame 12. The lock tongue module 40 is fixed to the central portion of the casing module 10. The first and second lock cylinders 51 and 57 are respectively inserted into the first through-holes 113 and 1211 and the second through-holes 114 and 1212. Via the slots 5110 and 5710 of the external threaded portions 511 and 571 of the first and second lock cylinders 51 and 57, when the first lock cylinder 51 is rotated, the horizontal plate 564 will be lifted up, and the second lock cylinder 57 is positioned at a fixed place. Then, the driving module 32 is fixed to the casing module 10. Thus, a coin operated device is installed on the locker 80.

Figure 7:
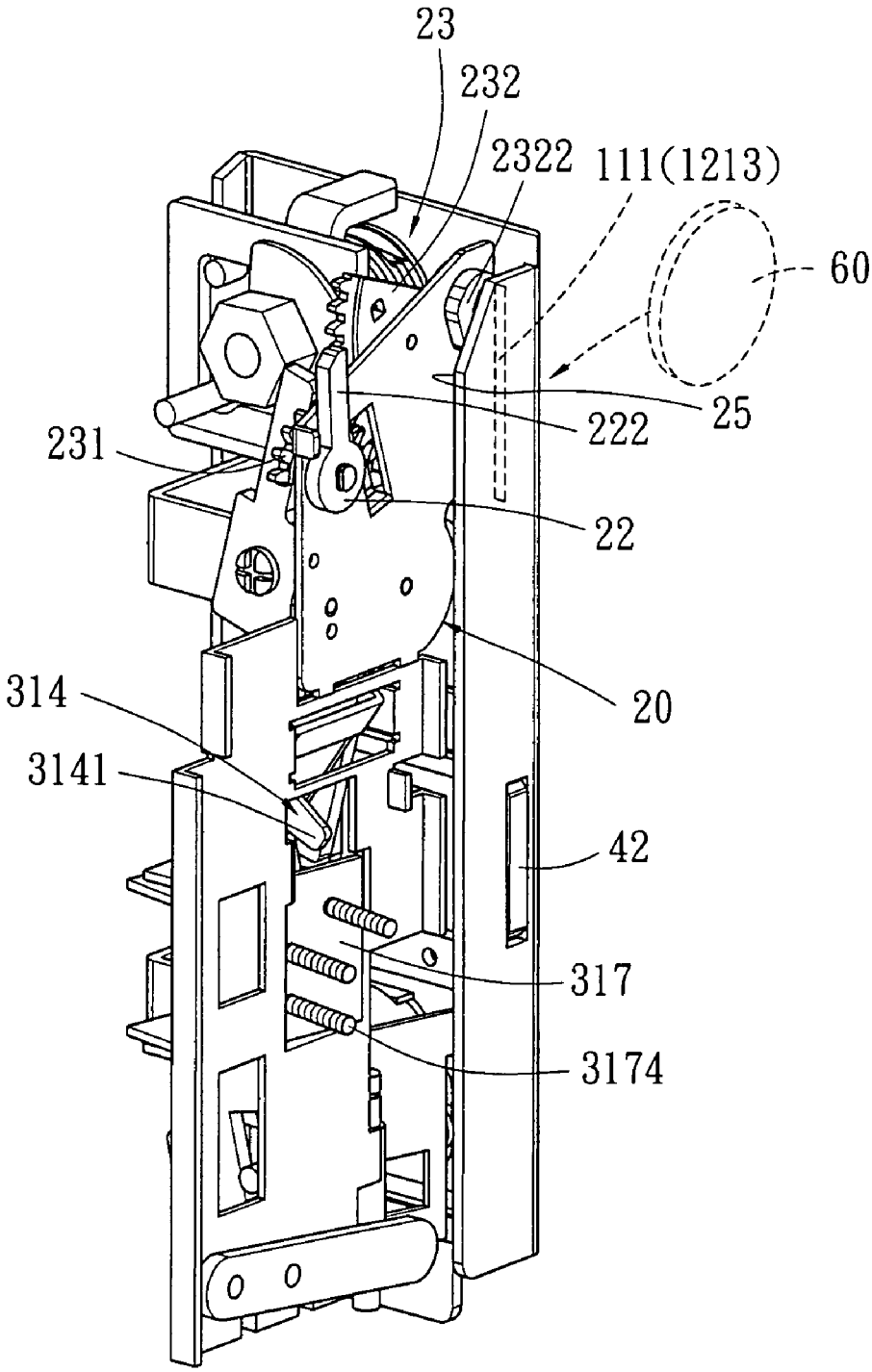
FIG. 7 is a rear view schematically showing that a coin is inserted into the coin slot according to the present invention.
Figure 8:
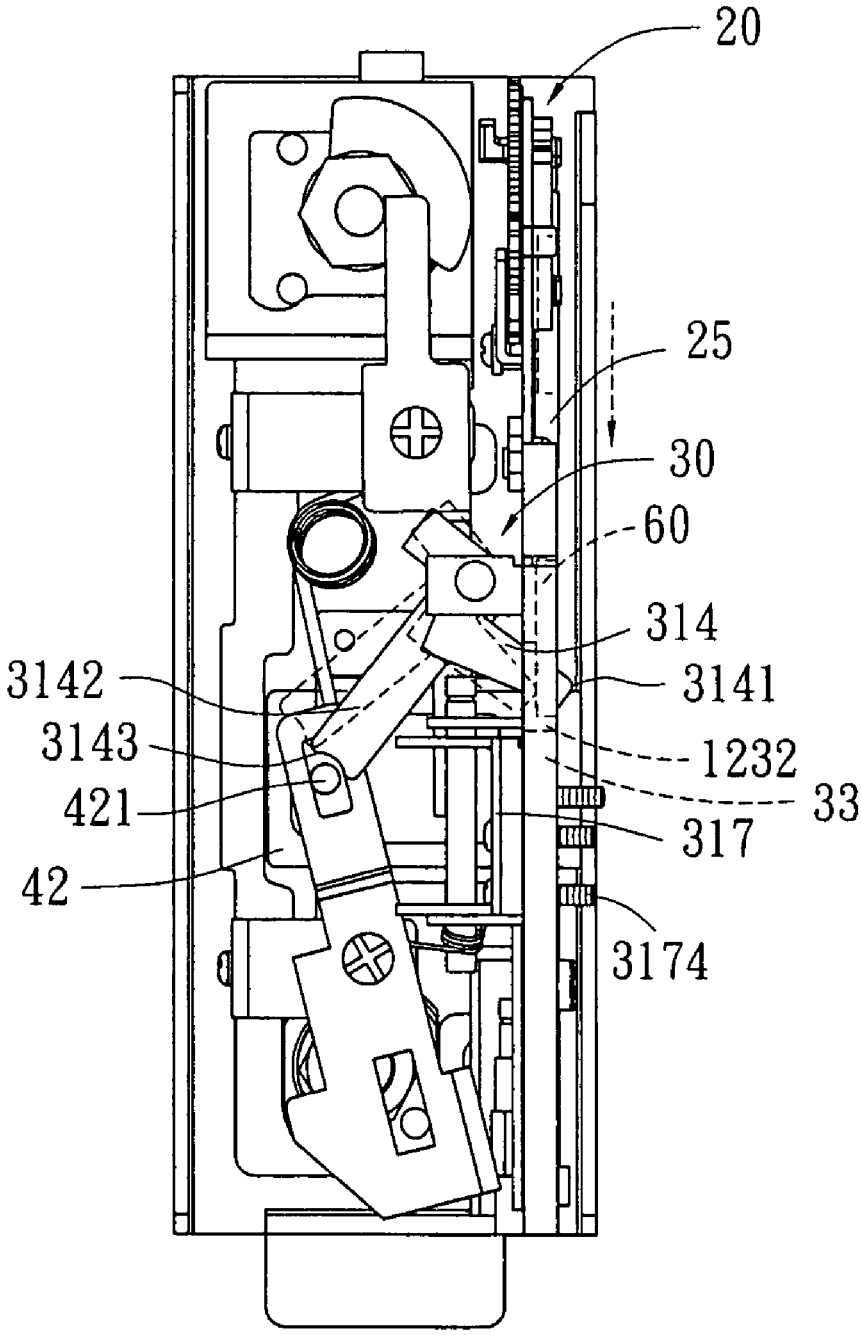
FIG. 8 is a diagram schematically showing that a coin falls from the coin slot to the slideway of the coin accommodation module according to the present invention.
Figure 9:
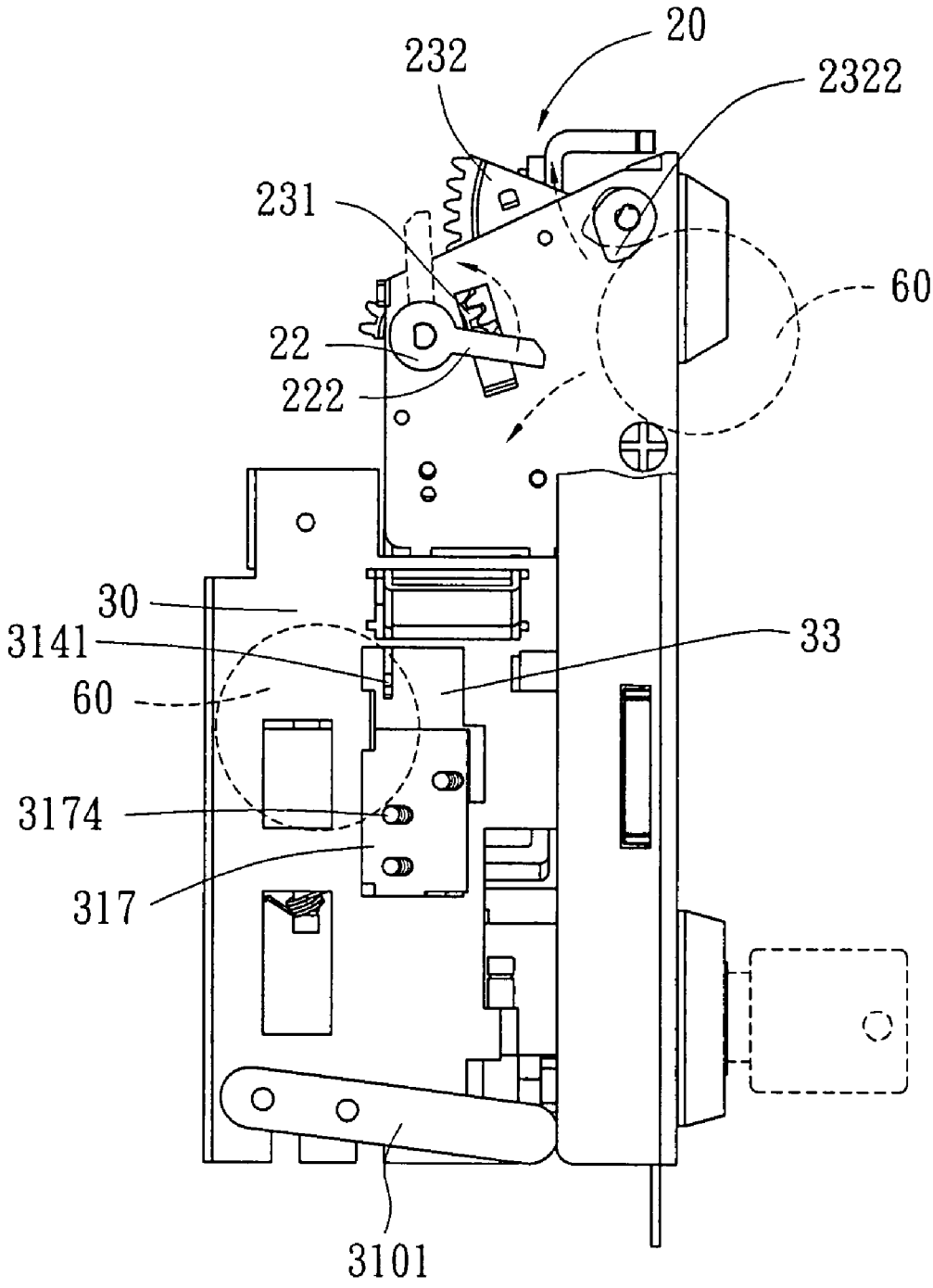
FIG. 9 is a side view schematically showing that a coin is inserted into the coin slot according to the present invention.
Figure 10:
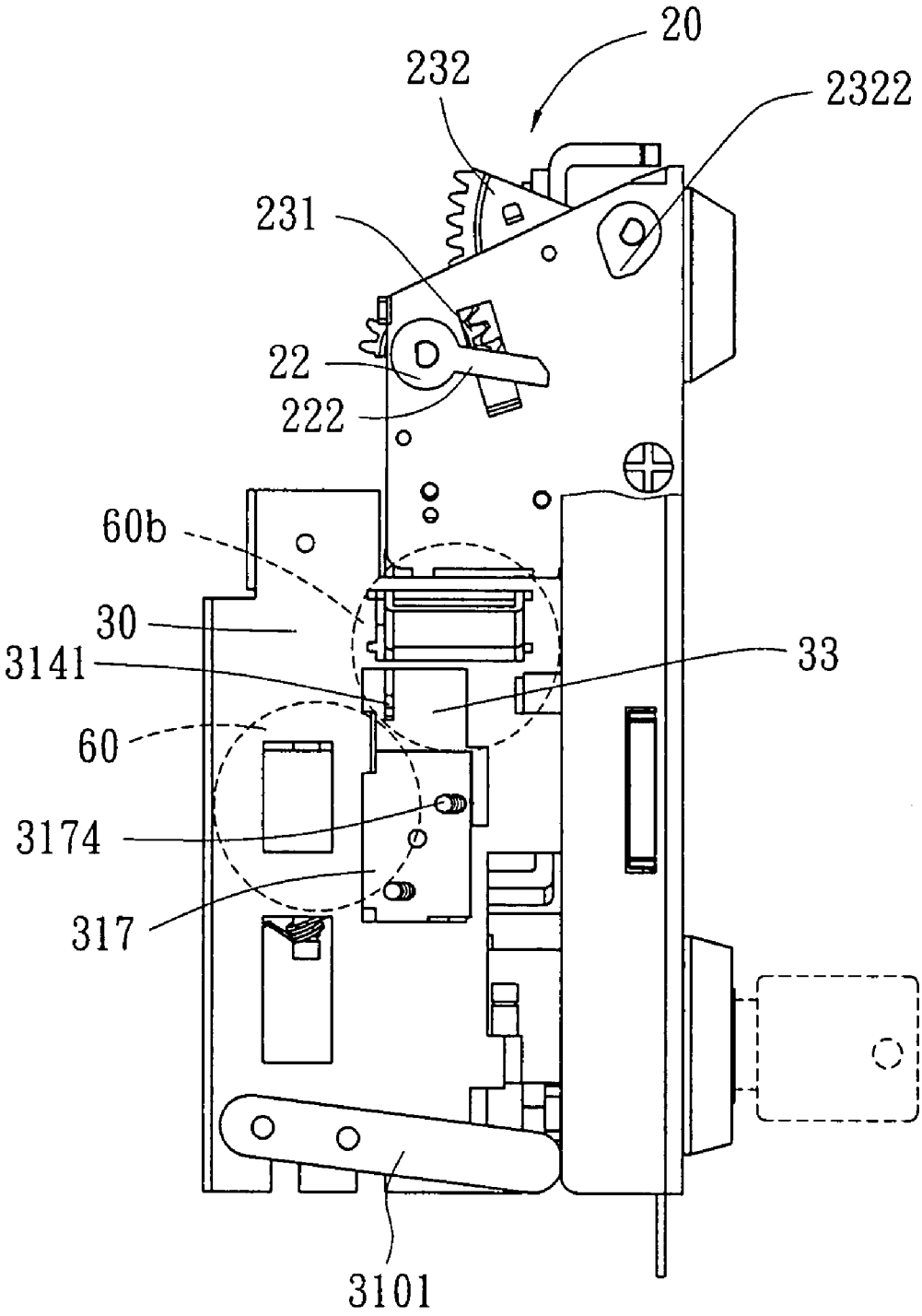
FIG. 10 is a side view schematically showing that two coins are sequentially inserted into the coin slot according to the present invention.
Figure 11:
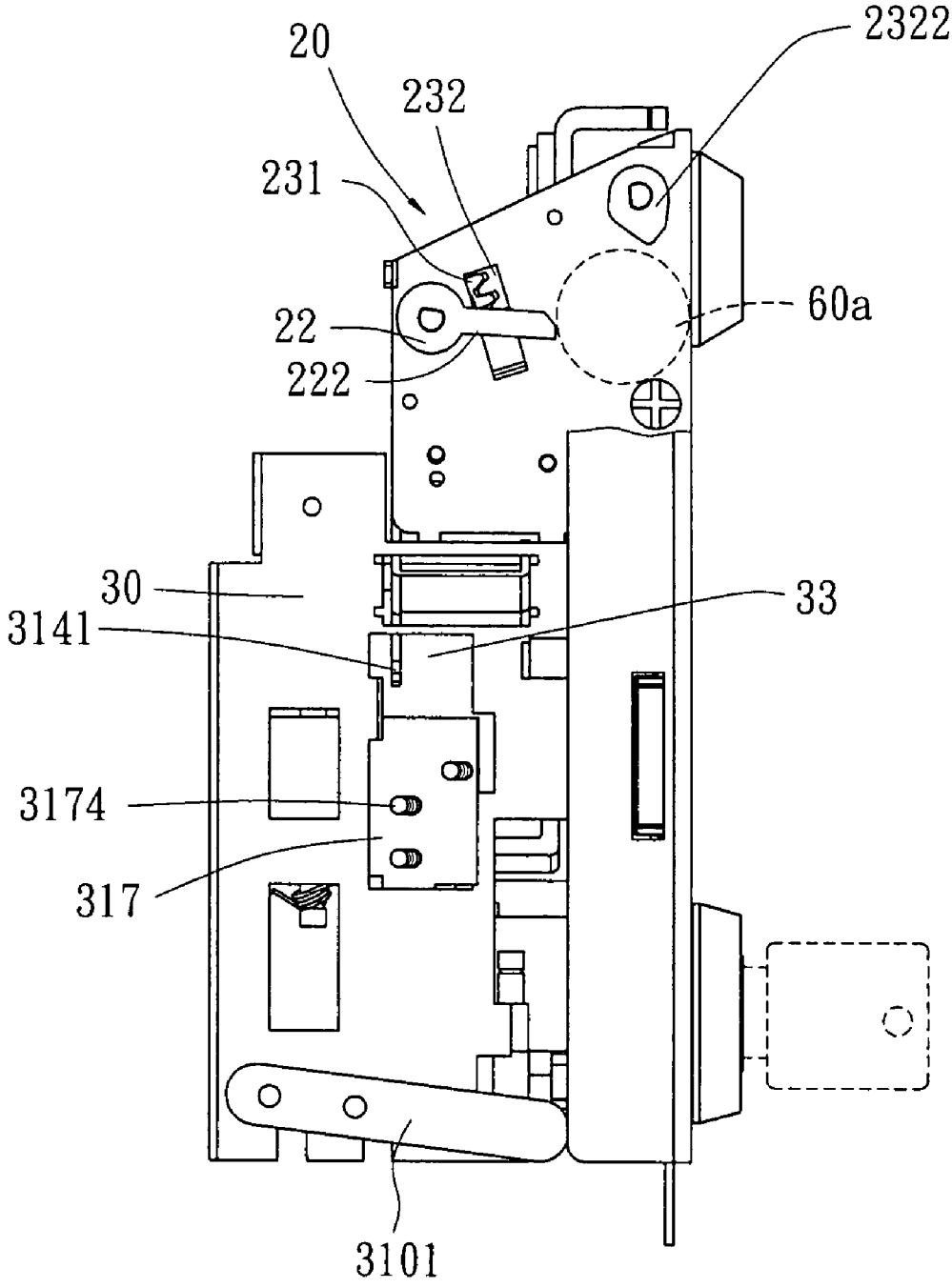
FIG. 11 is a side view schematically showing that too small a coin is inserted into the coin slot according to the present invention.
Figure 12:
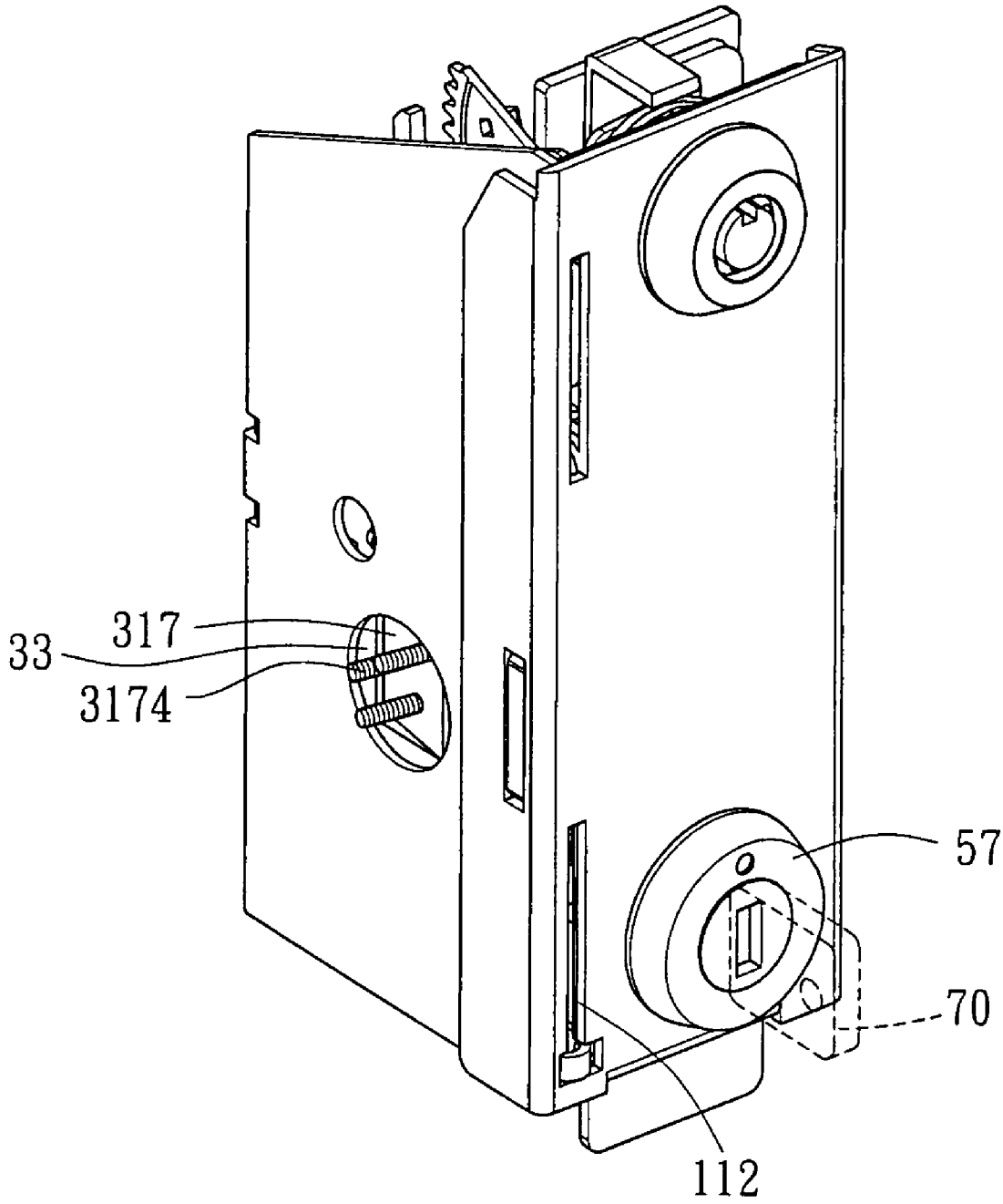
FIG. 12 is a diagram schematically showing that a locking operation is performed in the second lock cylinder according to the present invention.
Figure 13:
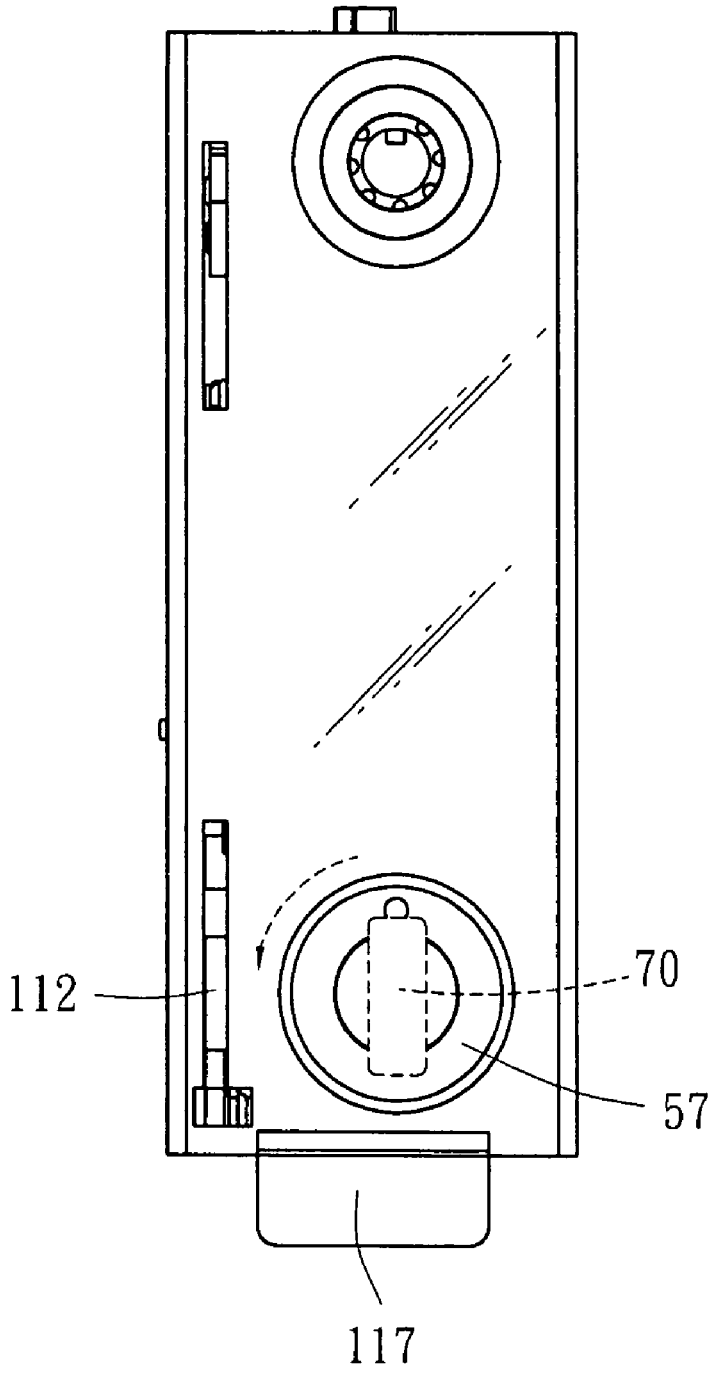
FIG. 13 is another diagram schematically showing that a locking operation is performed in the second lock cylinder according to the present invention.
Figure 14:
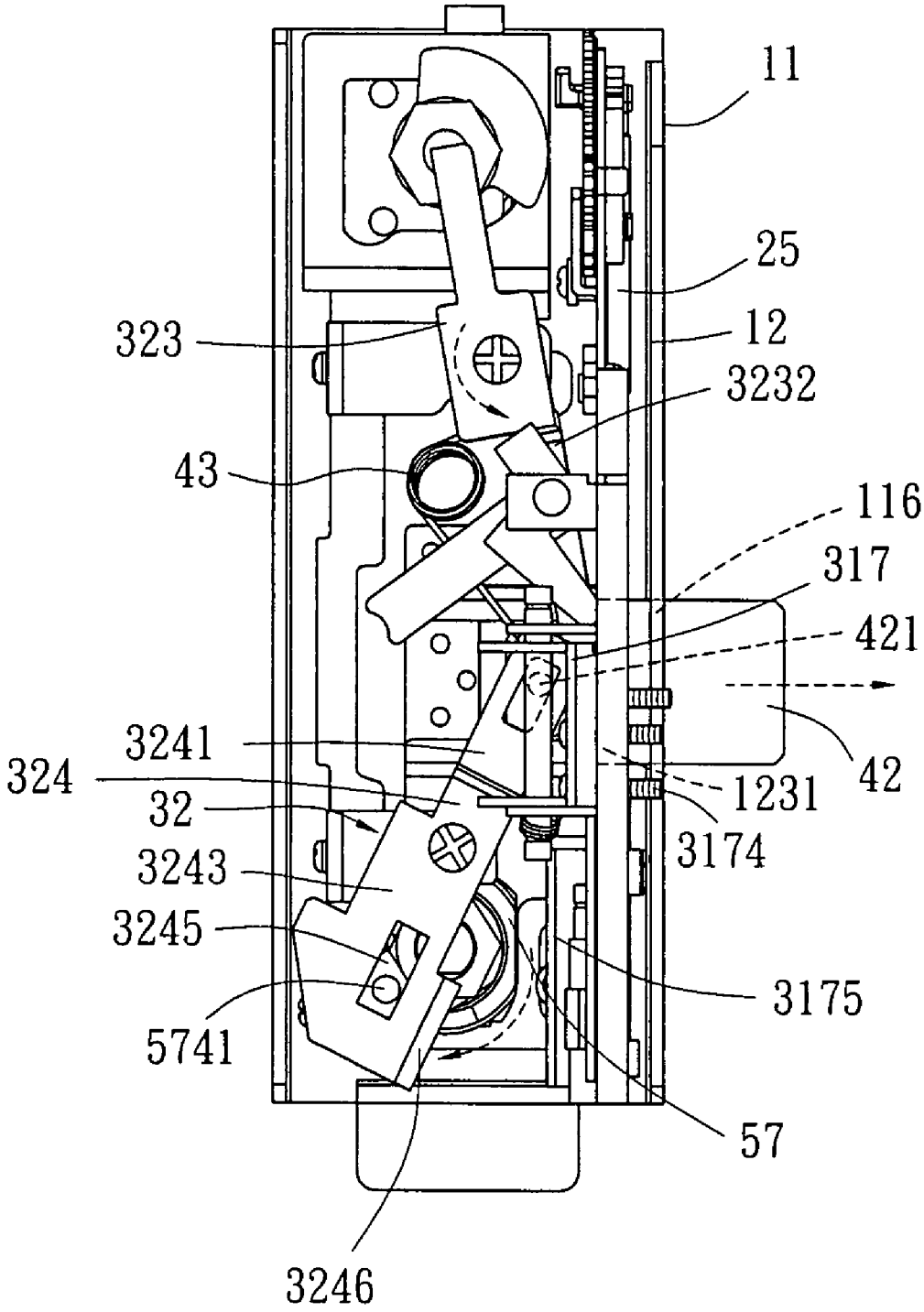
FIG. 14 is further another diagram schematically showing that a locking operation is performed in the second lock cylinder according to the present invention.
Figure 15:
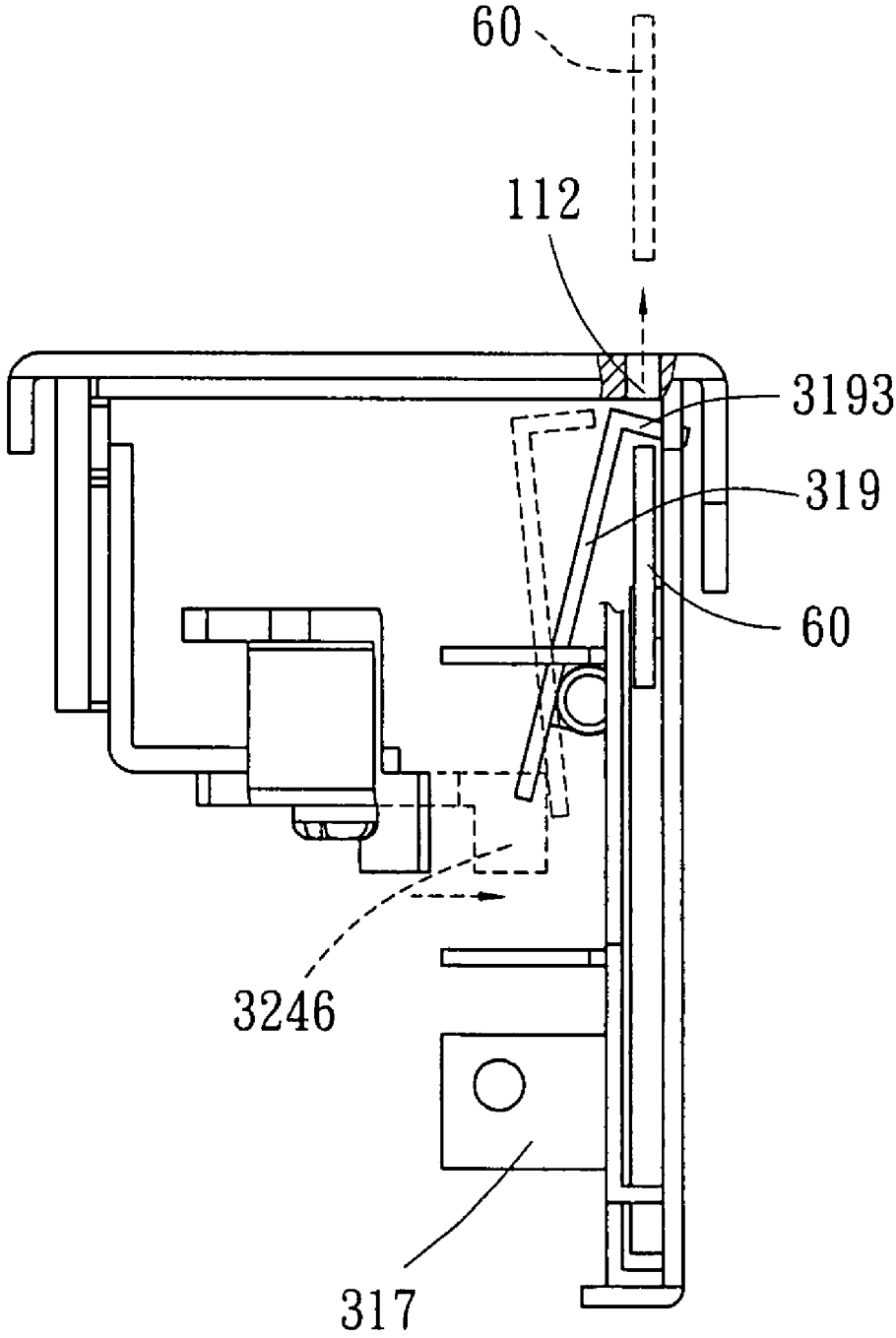
FIG. 15 is a top view schematically showing that a coin is wedged in the coin accommodation module according to the present invention.

Refer to from FIG. 7 to FIG. 9, and also to FIG. 1 for the application of the present invention. After a coin 60 of a given specification is inserted into the coin slot 111 and the through-hole 1213, the coin 60 triggers the triggering member 2322 of the coin triggered module 20. The corresponding active gear 232 of the transmission gear module 23 is thus rotated to drive the passive gear 231. The swing rod 222 corresponding to the passive gear 231 is also rotated upward. Next, the coin 60 passes through the slideway 25, and the protrusion 3141 of the protrusion board 314 originally penetrating the hole 1232 also moves outward. Next, the press block 3142, which is fitted to the rod 421 of the lock tongue 42, is also moved outward. Next, the coin 60 enters the slideway 33 of the coin accommodation module 30 and stays in above the screw elements 3174 of the blocking member 317. (As shown in FIG. 10, the screw elements 3174 may alternatively only arranged in below the blocking member 317; the coin 60 passes through the protrusion 3141 of the protrusion board 314 via the slideway 25 and then enters the slideway 33 of the coin accommodation module 30 and stays in the screw elements 3174 in the lower part of the blocking member 317; thus, a second coin **60*b* will stay in above the first coin 60.) Next, as shown in from FIG. 12 to FIG. 14, a key 70 is inserted into the keyhole of the second lock cylinder 57 and then turned 90 degrees for locking the locker 80. The rod 5741, whose terminal penetrates the elongated hole 3245, is rotated to drive the inserted plate 3243 of the second movable member 324 of the driving module 32 to move outward. Thus, the press plate 3246, which originally presses against the long plate 3175 of the blocking member 317, is moved to depart from the long plate 3175 of the blocking member 317, and the screw elements 3174 of the blocking member 317 is displaced. Consequently, the coin 60, which is originally blocked by the screw elements 3174 to stay in the slideway 25, falls to the slideway 33 of the coin accommodation module 30. Then, as shown in from FIG. 9 and FIG. 15, the coin 60 is blocked by the blocking plate 3193 of the movable plate 319 lest the coin 60 fall along the tilted stop block 3101 to the coin return 112. When the inserted plate 3243 is moved, the inserted plate 3241, which is at the side opposite to the inserted plate 3243, is moved to the opposite direction. As shown in FIG. 14, via the elastic element 43 installed in the rod 421, the lock tongue 42 is pushed to penetrate the through-hole 116 of the housing 11 and the through-hole 1231 of the mounting frame 12 to lock the locker 80. Then, the key 70 is withdrawn from the second lock cylinder 57, and the articles can thus be kept inside the locker 80. Refer to FIG. 15. When a user intends to take out the articles locked inside the locker 80, the key 70 is inserted into the second lock cylinder 57. The rod 5741 is turned reversely to push the inserted plate 3243 of the second movable member 324 of the driving module 32 to move inward. The press plate 3246 is moved to press against the long plate 3175 of the blocking member 317 and the movable plate 319 again. The blocking plate 3193 of the movable plate 319, which originally blocks the coin 60, is restored to the unblocking position. The screw elements 3174 of the blocking member 317 are restored to near the slideway 33. Thus, the coin 60 staying the slideway 33 is no more blocked by the blocking plate 3193 of the movable plate 319, and the user can then withdraw the coin 60 from the coin return 112**.

When a coin not meeting a given specification (too large or too small) is intended to be insert into the coin slot 111 and the through-hole 1213, a too large coin is obviously unlikely to enter the coin slot 111. Refer to FIG. 1. When a too small coin **60*a* is inserted into the coin slot 111 and the through-hole 1213, the coin 60*a* cannot touch the triggering member 2322 of the coin triggered module 20. Thus, the active gear 232 of the transmission gear module 23 will not rotate to drive the passive gear 231. Obviously, the swing rod 222 of the movable rod 22 will not swing upward. Therefore, the coin 60*a* cannot enter the slideway 25 of the coin triggered module 20 and the slideway 33 of the coin accommodation module 30, and the coin operated device of the locker 80** will not function.

Figure 5:
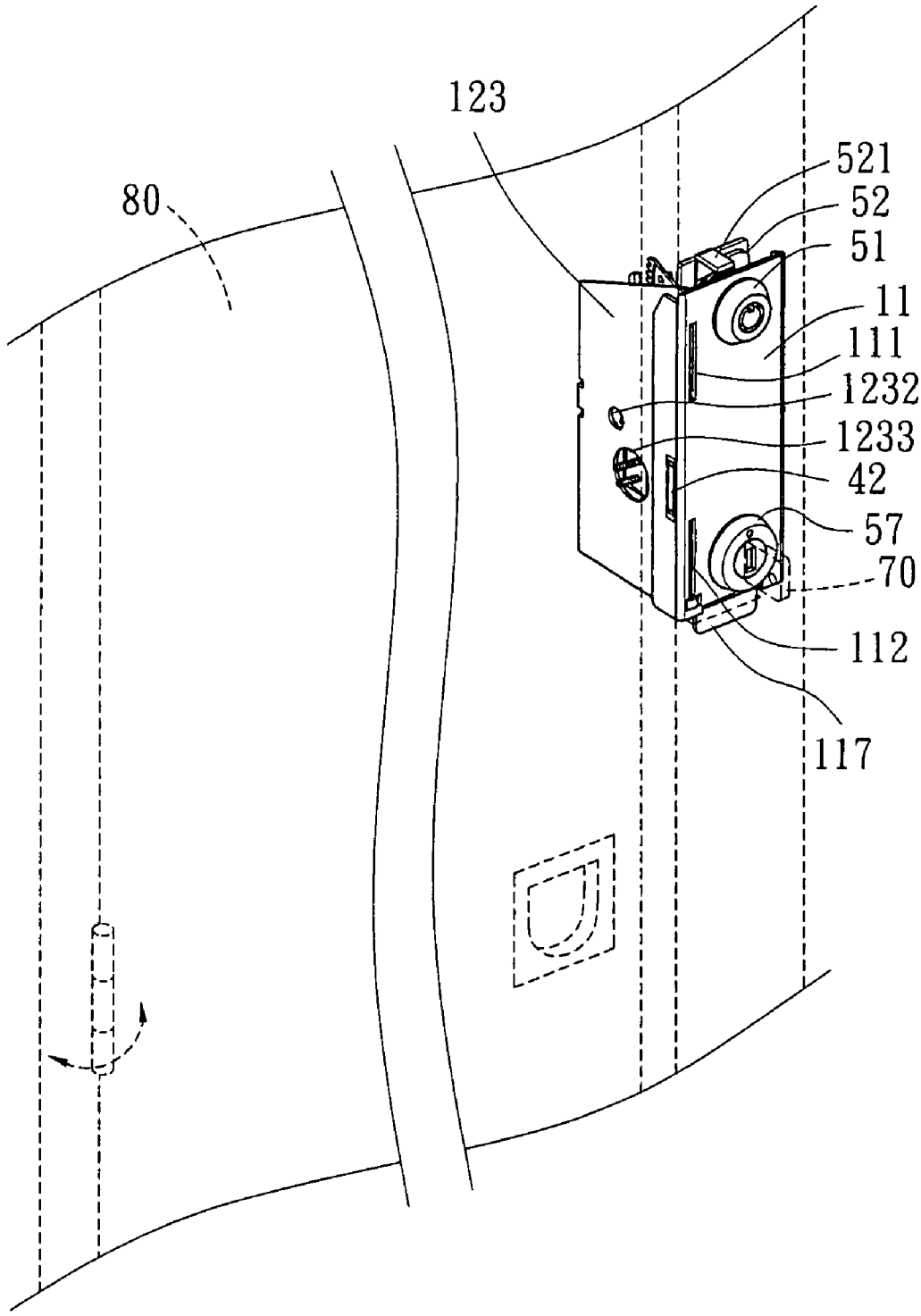
FIG. 5 is a diagram schematically showing that the present invention is installed in a locker.
Figure 16:
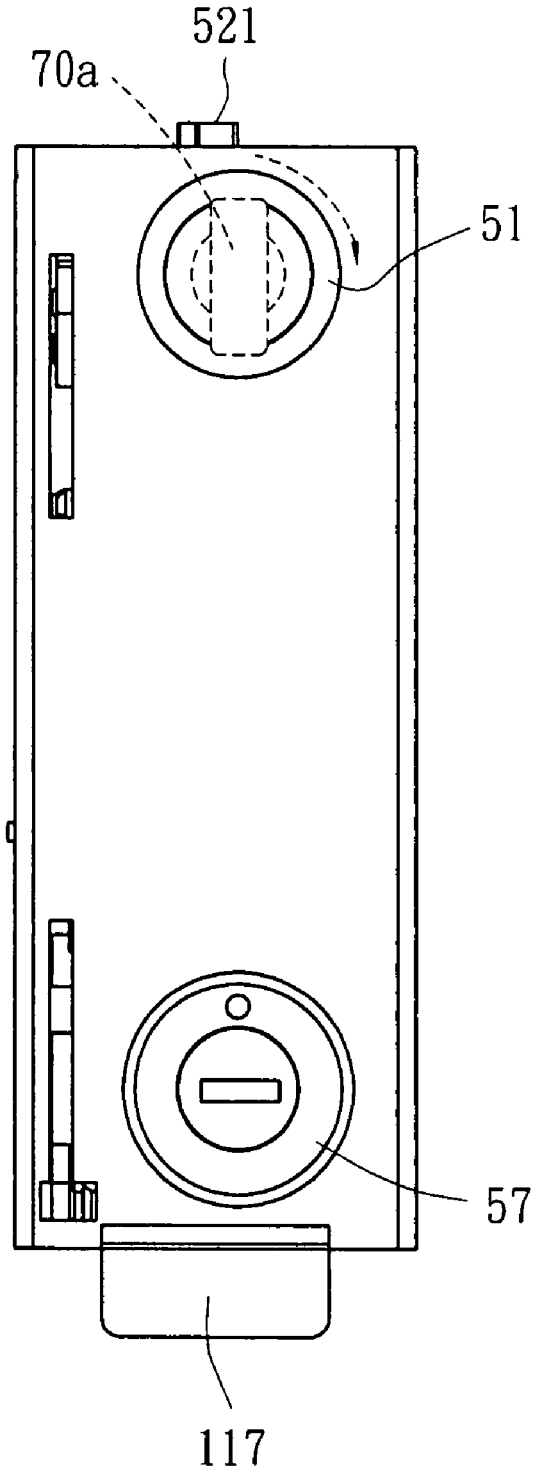
FIG. 16 is a diagram schematically showing that an unlocking operation is performed in the first lock cylinder according to the present invention.
Figure 17:
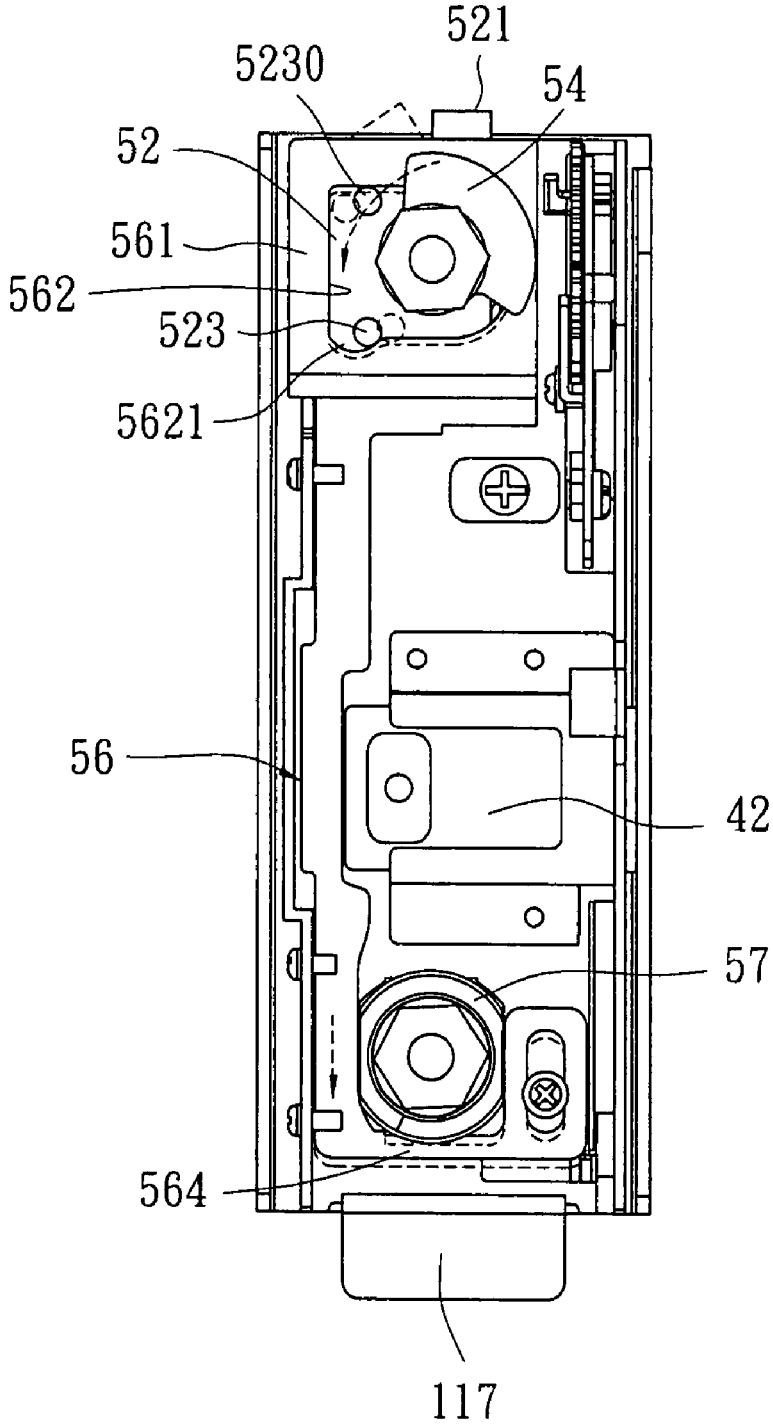
FIG. 17 is another diagram schematically showing that an unlocking operation is performed in the first lock cylinder according to the present invention.
Figure 18:
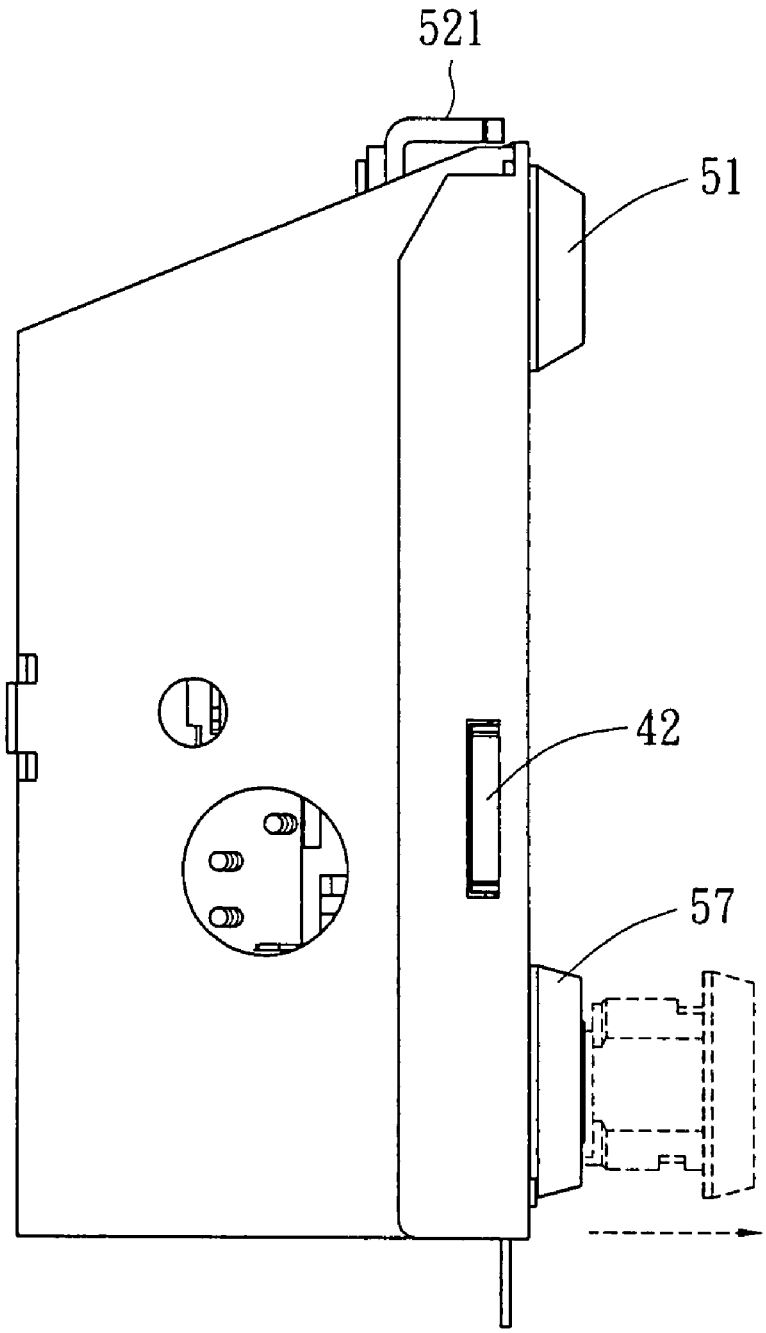
FIG. 18 is a diagram schematically showing that the second lock cylinder is taken out according to the present invention.

Refer to FIG. 5, FIG. 16 and FIG. 17. When a user intends to take out the articles locked inside the locker 80 but finds that the key 70 is lost, he may borrow a spare key **70*a* from the provider of the locker 80. The spare key 70*a* is inserted into the keyhole of the first lock cylinder 51 and turned to drive the blocking plate 521 of the tenon block 52, which is originally located inside the door frame of the locker 80, to rotate at the same direction. The positioning plate 54 is rotated to above the positioning plate 561. Thus, the rod 5230 at the upper portion of the tenon block 52, which is originally located inside the door frame of the locker 80, is moved downward from the upper portion of the opening 562 of the positioning plate 561 to drive the fixing plate 56 to descend. Thus, the second lock cylinder 57, which is originally wedged in the horizontal plate 564, departs from the horizontal plate 564. Then, the second lock cylinder 57 can be taken out from the coin operated device, as shown FIG. 18. The rod 523, which is originally wedged in a notch 5621, is also rotated to push the extension member 3231 of the first movable member 323. The swing plate 3232 of the first movable member 323 pushes the lock tongue 42 to move inward, and the inserted plate 3241 of the second movable member 324 is also moved. The press plate 3246, which is at the lateral side of the inserted plate 3243 at the opposite end of the inserted plate 3241, is restored to press the movable plate 319 and the long plate 3175 of the blocking member 317 against the separating board 31. Thereby, the entire coin operated device can be detached from the door frame of the locker 80, and the door of locker 80 can be opened to take out the articles inside the locker 80. Therefore, it is unnecessary for the present invention to break the entire coin operated device when the key 70** is lost.

In conclusion, the coin operated device of the present invention is applied to the door frame of a locker 80, wherein a key 70 is turned to rotate the underneath second lock cylinder 57 and unlatch the lock tongue 42 and detach the coin operated device from the door frame of the locker 80; thus, the articles inside the locker 80 can be taken out. Further, when the key 70 is lost, a spare key 70*a* is inserted into the first lock cylinder 51 to withdraw the lock tongue 42 and detach the coin operated device from the door frame of the locker 80. Therefore, via the present invention, the articles inside the locker 80 can still be taken out without damaging the coin operated device when the key 70 is lost.

What is claimed is:

1. A coin operated device comprising:

a casing module having a housing and a mounting frame, which can be fixed to each other, wherein said housing has a reversed U-shape structure; said housing has a coin slot and a coin return respectively at the upper portion and lower portion of one side thereof; the central portion of said housing has a first through-hole and a second through-hole; one side of said housing is bent to form a bent plate; said bent plate has a through-hole near the center thereof and has a press-fit plate at the lower end thereof; one plate of said mounting frame has a first through-hole and a second trough-hole respectively corresponding to said first through-hole and said second through-hole of said housing; one side of said mounting frame has a through-hole corresponding to said coin slot; a threaded pole is arranged beside said through-hole; a fixing plate and a positioning plate respectively extend from two sides of the plate and are vertical to said plate;

a coin triggered module installed at the upper side of said mounting frame and further comprises: a positioning block; a movable rod and a triggering member pivotally installed on one side of said positioning block, a transmission gear module including a passive gear and an active gear engaged to each other and pivotally installed on the other side of said positioning block and respectively corresponding said movable rod and said triggering member; and a fixing block fixed to the lower side of said positioning block;

a coin accommodation module installed in the lower end of the inner side of said mounting frame and further comprises: a separating board and a driving module, wherein said separating board has a fixing hole at the upper side thereof and two protrusion plates formed at one side thereof via a stamping method; a protrusion board is pivotally coupled to said protrusion plates; two protrusion plates are formed at the other side of said separating board via a stamping method; a blocking member is pivotally coupled to said protrusion plates via a shaft, and a spring sleeves one end of said shaft; two protrusion blocks are formed at the lower end of one side of said separating board via a stamping method; a movable plate is pivotally coupled to said protrusion blocks; the lower end of said separating board has two notches; a stop block can be fixed to the notches; said driving module has positioning members fixed to said fixing plate of said mounting frame, first and second movable members respectively fixed to said positioning members;

a lock tongue module arranged near the center of the inner side of said housing and further comprises: a positioning block, a lock tongue arranged in said positioning block, and an elastic element with one end thereof hooking the inner side of said plate and the other end thereof hooking a rod of said lock tongue; and a lock cylinder module further comprising a first lock cylinder and a second cylinder, wherein said first lock cylinder is inserted into said first through-hole of said housing and said first through-hole of said plate; said second lock cylinder is inserted into said second through-hole of said housing and said second through-hole of said plate; said first lock cylinder has a threaded pole; said threaded pole passes through a tenon block having a blocking plate, a plurality of washers and a positioning plate, and then they are locked by a locking element.

2. The coin operated device according to claim 1, wherein said first through-hole of said housing is an elongated hole; said second through-hole has a trapezoid shape at the upper side thereof and an arc shape at the lower side thereof.

3. The coin operated device according to claim 1, wherein fixing holes are respectively arranged at the upper and lower sides of said fixing plate.

4. The coin operated device according to claim 1, wherein the inner side of said positioning plate has a through-hole corresponding to said through-hole of said housing; said positioning plate also has a hole and a through-hole and further has fixing holes diagonally arranged in the upper and lower sides thereof.

5. The coin operated device according to claim 1, wherein said positioning block has a protrusion at one corner thereof; the upper side of said positioning block has a through-hole; said positioning block has two pivotal holes respectively at two ends of the upper side thereof and has a plurality of holes at the lower side thereof; a rod is arranged below said pivotal hole of said positioning block.

6. The coin operated device according to claim 1, wherein one end of said movable rod is a pivotal end, and the other end of said movable rod is a swing rod.

7. The coin operated device according to claim 1, wherein said active gear has a hook used to hook an elastic element.

8. The coin operated device according to claim 1, wherein a slideway for a coin is formed between said positioning block and said positioning plate.

9. The coin operated device according to claim 1, wherein a stop block is arranged in said notches at the lower end of said separating board and used to block a coin.

10. The coin operated device according to claim 1, wherein said protrusion board is pivotally coupled to the upper portion of said separating board with a shaft; said protrusion board has a shape similar to "7" and has a protrusion at the terminal thereof; a connecting plate connects the top of said protrusion board with a press block.

11. The coin operated device according to claim 1, wherein said movable plate together with a spring is pivotally coupled to the lower end of said separating board via a shaft; said movable plate is a crooked plate, and one side thereof has a protrusion; one corner of said movable plate has an oblique arm with a blocking plate.

12. The coin operated device according to claim 1, wherein said positioning block has notches to from slideways and has fixing edges in the lateral sides thereof; said fixing edge has fixing holes, which fixing screws are to be inserted into.

13. The coin operated device according to claim 1, wherein said blocking member has two protrusion plates corresponding to and pivotally coupled to said protrusion plates; a protrusion plate below said protrusion plates has several threaded holes, and several screw elements will be screwed into said threaded holes; one said protrusion plate extends a long plate.

14. The coin operated device according to claim 1, wherein said two positioning members are similar to a segment of angle steel; one face of said positioning member has threaded holes; the other face of said positioning member has a threaded hole.

15. The coin operated device according to claim 1, wherein said first movable member has a hole; one end of said first movable member has an extension member, and the other end is crooked into a swing plate.

16. The coin operated device according to claim 1, wherein said second movable member has an inserted plate and an inserted plate; said inserted plate has an elongated hole; said inserted plate has a hole, an elongated hole, and a press plate, which is formed via bending the lateral side of said inserted plate.

17. The coin operated device according to claim 1, wherein said lock tongue has a rod, which penetrates an elongated hole of an inserted plate.

18. The coin operated device according to claim 1, wherein said first/second lock cylinder has an external threaded portion; said external threaded portion has a slot and two flattened faces arranged oppositely.

19. The coin operated device according to claim 1, wherein the upper corner of said tenon block is bent to form a blocking plate; said tenon block has a through-hole and two rods formed on one side of said tenon block.

20. The coin operated device according to claim 1, wherein a fixing plate is arranged in the inner side of said housing; the upper portion of said fixing plate is bent to form a positioning plate, and said positioning plate has an opening; the lower portion of said fixing plate is bent to form a vertical plate and a horizontal plate, and a fixing plate extends from the terminal of said horizontal plate.

* * * * *